United States Patent [19]

Kuchinski et al.

[11] Patent Number: 4,689,120

[45] Date of Patent: Aug. 25, 1987

[54] APPARATUS FOR THE RECOVERY OF OIL FROM SHALE

[75] Inventors: Joseph Kuchinski; Risdon W. Hankinson, both of Bartlesville; Charles J. Rosvold, Tulsa, all of Okla.

[73] Assignee: Phillips Petroleum Company, Bartlesville, Okla.

[21] Appl. No.: 744,836

[22] Filed: Jun. 14, 1985

[51] Int. Cl.[4] ..... C10B 1/10; C10B 7/06

[52] U.S. Cl. ..... 202/117; 202/262; 202/265; 202/270; 201/28; 201/33; 201/37

[58] Field of Search ..... 208/8 R, 11 R, DIG. 1; 201/1, 28, 32, 33, 36, 37; 202/99, 108, 117, 118, 262, 265, 270

[56] References Cited

U.S. PATENT DOCUMENTS

| | | | |
|---|---|---|---|
| 2,705,697 | 4/1955 | Royster | 201/36 |
| 2,899,189 | 9/1959 | Matio et al. | 263/28 |
| 2,908,617 | 10/1959 | Murphree | 201/28 |
| 3,302,936 | 2/1967 | Ban | 263/28 |
| 3,325,395 | 6/1967 | Ban | 208/11 R |
| 3,483,115 | 12/1969 | Haddad et al. | 208/11 |
| 3,560,368 | 2/1971 | Rowland et al. | 201/37 |
| 3,560,369 | 2/1971 | Rowland et al. | 208/11 R |
| 3,644,193 | 2/1972 | Weggel et al. | 208/11 R |
| 4,033,730 | 7/1977 | Baron et al. | 202/262 |
| 4,039,427 | 8/1977 | Ban | 208/11 R |
| 4,058,905 | 11/1977 | Knight | 34/15 |
| 4,082,645 | 4/1978 | Knight et al. | 208/11 R |
| 4,133,741 | 1/1979 | Weichman et al. | 208/11 R |
| 4,193,862 | 3/1980 | Ban et al. | 208/11 R |
| 4,200,517 | 4/1980 | Chalmers et al. | 201/32 |
| 4,347,119 | 8/1982 | Thomas | 202/117 |
| 4,388,174 | 6/1983 | Magedanz et al. | 201/32 |
| 4,412,909 | 11/1983 | Faulkner et al. | 208/11 R |
| 4,419,216 | 12/1983 | Magedanz et al. | 201/32 |
| 4,425,220 | 1/1984 | Kestner, Jr. | 201/32 |
| 4,441,985 | 4/1984 | Burchfield et al. | 201/32 |

FOREIGN PATENT DOCUMENTS

| | | | |
|---|---|---|---|
| 3124277 | 1/1983 | Fed. Rep. of Germany | 31/2 B |

OTHER PUBLICATIONS

Knight & Fishback, "Superior's Circular Grate and Australian Rundle . . . Process Design", 12th, OSSP, Co. Sch. Mn, 1979.

Knight ". . . Superior Circular Grate . . . Process", Oil Shale Processing Tech., p. 137 et seq.

*Primary Examiner*—David L. Lacey

*Attorney, Agent, or Firm*—John R. Casperson

[57] ABSTRACT

An apparatus for the recovery of oil from shale is disclosed in which the shale travels through processing zones on a moving grate. Among the processing zones are a destructive distillation zone and a carbon combustion zone. A conduit is provided for recirculating gases to the carbon combustion zone.

11 Claims, 1 Drawing Figure

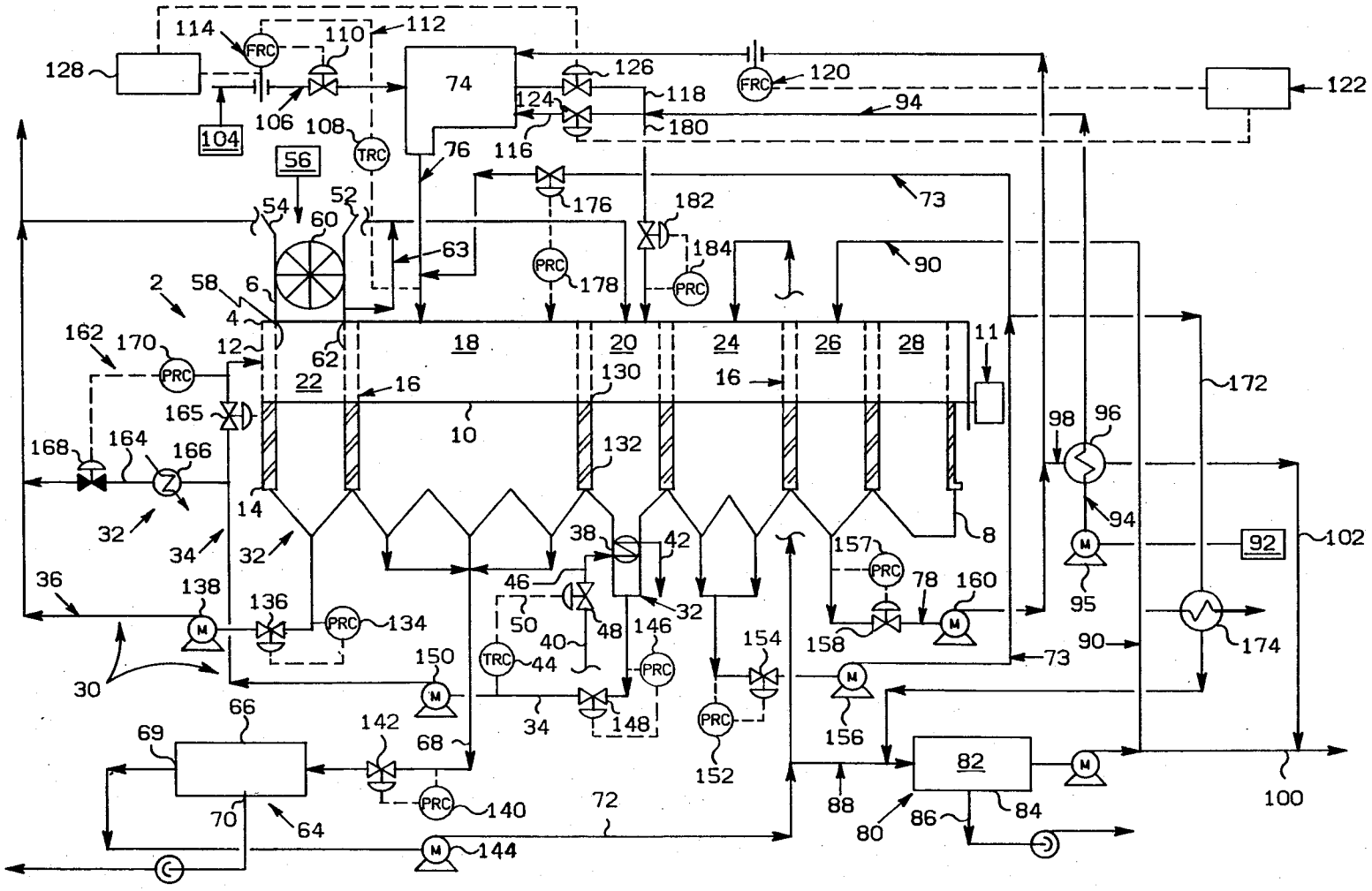
122
102
100
92
174
172
96
94
95
90
98
73
11
8
160
78
157
158
156
88
84
82
86
80
28
26
24
16
20
130
132
18
10
22
14
12
6
4
2
58
54
56
52
60
62
63
76
74
112
110
108
106
114
104
128
120
FRC
118
180
126
124
116
182
184
PRC
176
178
42
32
146
148
38
48
40
44
TRC
46
50
34
72
140
144
68
150
142
134
136
138
64
66
70
69
30
36
165
166
164
168
162
170
152
154

APPARATUS FOR THE RECOVERY OF OIL FROM SHALE

BACKGROUND OF THE INVENTION

The invention relates to a grate retort. In another aspect, the invention relates to retorting a material on a moving grate to recover hydrocarbon values.

Various mineral materials, such as oil shale, lignite, and tar sands contain hydrocarbon values. Retorting is one manner in which the hydrocarbon values can be recovered from the minerals in a more usable liquid or gaseous form. One type of retorting system utilizes a traveling grate to transport the material through a retorting zone. The material is generally subjected to several other steps in addition to retorting for reasons of economy. Usually, residual carbonaceous material remaining on the residue from the retorting step will be burned off to form hot combustion gases and hot particulate residue. The combustion gases are conveyed to some other heat requiring step. The hot particulate residue is usually cooled prior to being discharged and the hot gases formed in cooling the residue are conveyed to some other heat requiring step. Recovery of the hydrocarbon values from the mineral matter as a high value product and maximizing exploitation of the residual energy value of the mineral matter is an area of extensive research.

OBJECTS OF THE INVENTION

It is an object of this invention to provide a process for recovering oil and energy from a mineral material containing hydrocarbon values with a high degree of efficiency.

It is another object of this invention to provide an apparatus for recovering oil from a mineral material containing hydrocarbon values characterized by highly efficient energy recovery and conversion of the hydrocarbon values into oil.

SUMMARY OF THE INVENTION

The invention provides a process for recovering oil from a mineral material containing hydrocarbon values. The mineral material is carried on a grate sequentially through a destructive distillation zone and a carbon recovery zone which are defined in a housing. Hot gases are circulated through the material in the destructive distillation zone and combustible gases and oil are withdrawn. An oxygen-containing gas is introduced into the carbon recovery zone to burn off residual carbon. By maintaining the oxygen and combustible gas concentration in the carbon recovery zone at low values, carbon burnoff can be increased and the temperature of the effluent gases and the amount of carbonate decomposition can be controlled. In one aspect, the oxygen content of the oxygen-containing gas introduced into the carbon recovery zone is reduced by dilution with cooled combustion gases recovered from a preheating zone.

In another aspect of the present invention there is provided an apparatus which comprises a housing and a movable grate positioned in the housing dividing it into an upper portion and a lower portion. The housing has an inlet for introducing particulate material into it and an outlet for exhausting the particulate material and the grate is coupled to a means for moving it through the housing. The housing is divided into zones along the path of the grate. Each of the zones is divided into an upper portion and a lower portion by the grate and has a fluid inlet in the upper portion and a fluid outlet in the lower portion. The housing is divided into at least a destructive distillation zone and a carbon combustion zone. The apparatus is characterized by a conduit means defining a flow path from the lower portion of the carbon combustion zone to the upper portion of the carbon combustion zone, and a means for cooling the contents of the conduit means.

BRIEF DESCRIPTION OF THE DRAWING

The FIGURE schematically illustrates certain features of an embodiment of the present invention as applied to a circular moving grate retort.

DETAILED DESCRIPTION OF THE INVENTION

According to certain aspects of the invention, a retort 2 comprises a housing 4 having an inlet 6 for introducing particulate material and an outlet 8 for exhausting particulate material. A movable grate 10 is positioned in the housing 4, dividing it into an upper portion 12 and a lower portion 14. The grate 10 is movable through the housing by a means 11. The housing 4 is divided into physically separated zones along the path of the grate 10, for example, by a means 16. Each of the zones is divided into an upper portion and a lower portion corresponding to the upper portion 12 and lower portion 14 into which the housing is divided by the movable grate 10. The housing 4 is divided into at least a destructive distillation zone 18 and a carbon combustion zone 20. In one embodiment, the housing 4 is further divided into a preheating zone 22, a first heat recovery zone 24 and a second heat recovery zone 26. A fluid inlet is provided in the upper portion of each zone and a fluid outlet is provided in the lower portion. A dump zone 28 can be provided apart from the other zones which has the particulate material outlet in its lower portion. The apparatus is characterized by a means 30 separate from the housing for defining a flow path from a lower portion of the carbon combustion zone 20 to the upper portion of the carbon combustion zone 20, said means 30 being routed into heat exchange relationship with means 32 for cooling its contents.

The grate 10 is preferably circular and the housing 4 surrounding it is preferably generally toroidal in shape. The destructive distillation zone 18 is preferably positioned between the preheat zone 22 and the carbon combustion zone 20. In one embodiment of the invention, the means 30 defining a flow path between the lower portion of the carbon combustion zone 20 and the upper portion of the carbon combustion zone 20 comprises a first conduit means 34 connecting the lower portion of the carbon combustion zone 20 with the upper portion of the preheat zone 22 and a second conduit means 36 connecting the lower portion of the preheating zone 22 with the upper portion of the carbon combustion zone 20. In this arrangement, the preheating zone 22 forms at least a portion of the means 32 for cooling the contents of the means 30 defining the flow path between the lower portion of the carbon recovery zone 20 and the upper portion of the carbon recovery zone 20.

In a further embodiment, the cooling means 32 for cooling contents of means 30 includes a cooler 38. Preferably, the cooler 38 is formed by an indirect heat exchanger, most preferably a steam generator. It can be conveniently located in or adjacent to the lower portion of the carbon combustion zone 20 and is connected with a source 40 of cooling fluid, usually water or steam. Steam can be withdrawn from the cooler 38 via line 42. Flow of coolant from source 40 to the cooler 38 can be controlled by means of a temperature sensor 44 associated with the first conduit means 34 between the cooler 38 and the preheat zone 22. A suitable temperature sensor 44 is a temperature recorder controller operable for producing a signal representative of the fluid temperature in the first conduit means 34. A cool fluid feed line 46 connects the source 40 with the cooler 38 and has a valve 48 positioned therein. A means 50 which can be pneumatic, hydraulic or electrical, for example, is associated with the temperature sensor 44 and the valve 48 for manipulating the valve 48 responsively to the signal from the temperature sensor 44, thereby controlling fluid flow to the cooler 38.

In another aspect, the housing 4 can be provided with a tubular chute 52 emptying into the upper portion of the preheat zone 22 and forming the inlet 6 for introducing particulate material into the housing 4. The chute 52 has an upper end 54 positioned to receive particulate material from a source 56 of particulate material and a lower end 58 positioned so as to deposit particulate material on the movable grate 10. A particle feeder 60 such as a rotary star valve or a screw feeder is positioned near an upper portion of the chute 52 to control the admission of particulate material into the chute 52. A valve or choke 62 throttles the exhaust of particulate material from the chute 52 onto the grate 10. Where the tubular chute 52 is used, the means 30 defining the flow path from the lower portion of the carbon combustion zone 20 to the upper portion of the carbon combustion zone 20 can further comprise a conduit means 63 connecting an upper portion of the chute 52 with the upper portion of the carbon combustion zone 20.

For further efficiency of heat recovery, the housing 4 can be divided by the means 16 to form the first heat recovery zone 24, the carbon combustion zone 20 being positioned between the first heat recovery zone 24 and the destructive distillation zone 18. The fluid inlet in the upper portion of the first heat recovery zone 24 can be connected to a source of gaseous fluid 64 such as a gas/liquid separation zone 66. The gas/liquid separation zone 66 can be connected to the fluid outlet in the lower portion of the destructive distillation zone 18 by conduit means 68. The gas/liquid separation zone 66 is provided with a gas outlet 69 and a liquid outlet 70. A conduit means 72 connects the gas outlet 69 of the gas liquid separation means 66 with the fluid inlet in the upper portion of the first heat recovery zone 24. A conduit means 73 can connect the fluid outlet in the lower portion of the first heat recovery zone 24 with the fluid inlet in the upper portion of the destructive distillation zone 18.

According to still further aspects of the present invention, there is provided an external combustor 74 which is connected by a conduit means 76 to the fluid inlet in the upper portion of the destructive distillation zone 18. The housing 4 can be further divided by the means 16 to form the second heat recovery zone 26, the first heat recovery zone 24 being positioned between the second heat recovery zone 26 and the carbon combustion zone 20; the preheating zone 22, the destructive distillation zone 18, the carbon combustion zone 20, the first heat recovery zone 24 and the second heat recovery zone 26 being serially arranged. The fluid outlet in the lower portion of the second heat recovery zone 26 can be connected to the external combustor 74 by a conduit means 78. A conduit means 80 connects the gas outlet 69 of the gas liquid separation zone 66 with the fluid inlet in the upper portion of the second heat recovery zone 26. Preferably, the conduit means 80 includes part of the conduit means 72 and further comprises a condenser 82 having a vapor outlet 84 and a liquid outlet 86, the condenser 82 being connected to the conduit means 72 by a conduit means 88, the vapor outlet 84 of the condenser 82 being connected to the fluid inlet in the upper portion of the second heat recovery zone 26 by a conduit means 90.

A source of oxygen-containing gas 92 is connected to the external combustor 74 by a conduit means 94. Preferably, the conduit means 94 includes a blower 95 and an indirect heat exchanger 96 such as a heater. A conduit means 98 connects the fluid outlet in the lower portion of the second heat recovery zone 26 with the heater to provide the working fluid. The conduit means 98 preferably includes a portion of the conduit means 78. The heater 96 can discharge the working fluid to a vapor outlet line 100 from the vapor outlet of the condensor 82 via a line 102.

A source of supplemental fuel 104 and a conduit means 106 connecting the source of supplemental fuel with the external combustor 74 is a desirable feature to assist in maintaining the unit in heat balance. The supplemental fuel usage can be controlled with a temperature sensor 108 associated with the conduit means 76 connecting the external combustor 74 with the destructive distillation zone 18. The temperature sensor 108 is operable for producing a signal representative of the fluid temperature in the conduit means 76, preferably a signal representative of the temperature of the hot gases entering the zone 18. A valve 110 is positioned in the conduit means 106 which connects the source of supplemental fuel with the external combustor 74. A means 112 is associated with the second temperature sensor 108 and the second valve 110 for manipulating the second valve 110 responsively to the signal from the second temperature sensor 108. Preferably, the means 112 comprises a means 114 associated with the conduit means 106 for determining the rate of flow therethrough. A suitable means 114 can be a flow recorder controller, for example. The flow recorder controller 114 produces a signal representative of the rate of fluid flow through the conduit means 106, biases it with the signal established by the temperature recorder controller 108 and manipulates the valve 110 responsively to the temperature in the conduit means 106.

Preferably, the supplemental fuel introduced into the external combustor 74 via conduit 106 and the primary fuel introduced into the external combustor 74 via the conduit means 78 are combusted with oxygen-containing gas introduced into the combustor 74 via the conduit means 94 at near stoichiometric conditions. Preferably, the conduit means 94 includes a first branch line 116 and a second branch line 118 each connecting to the combustor 74 and flow through the first branch line 116 is manipulated responsively to the flow through the conduit means 94 and the flow through the second branch line 118 is manipulated responsively to the flow through the conduit means 106. Control can be accomplished by a means 120 associated with the conduit means 78 for establishing a signal representative of the rate of fluid flow through the conduit means 78 and a means 122 for receiving the signal from the means 120 and establishing a signal used to manipulate a valve 124 in the first branch line 116. A suitable means 120 comprises a flow recorder controller. A suitable means 122 can comprise a ratio controller. The signal received by the valve 124 from the ratio controller 122 can be electric, pneumatic or hydraulic in nature, for example. Similarly, a valve 126 positioned in the second branch line 118 receives a signal from a means 128 and is manipulated thereby to control the rate of fluid flow through the line 118. The means 128 can comprise a ratio recorder controller, for example. The means 128 is associated with the flow recorder controller 114 so as to receive a signal therefrom representative of the rate of fluid flow through the line 106 and manipulate the valve 126 in response to the signal.

For good operating results, it is preferred in one embodiment that each of the zones 18, 20, 22, 24 and 26 be operated at about the same pressure and utilize downflow of gases through the grate. By maintaining the zones at about equal pressure, cross flow between the zones can be drastically reduced. Preferably the means 16 dividing the housing in the zones is formed by a series of curtains or flaps 130 above the grate 10 and partitions or baffles 132 below the grate. A gas purge, such as an inert gas purge, can be utilized between the flaps, if desired, to cut down on cross flow. The further the zones are spaced apart by the means 16, the less gas leakage will occur between them. This type of seal, however, reduces throughput capacity of the device because active traveling grate area must be used to provide the seal space between the zones. The sides of the grate 10 can be liquid sealed, for example, to prevent gas channeling around the sides of the grate. In addition to the curtains and partitions above and beneath the traveling grate, each of the zones 18, 20, 22, 24 and 26 has a means associated therewith so that the zones will be maintained at about equal pressure with respect to each other. To accomplish this, a pressure recorder controller 134 connected to a motor valve 136 and a blower 138 are associated in series with the fluid outlet of the preheating zone 22; a pressure recorder controller 140 connected to a motor valve 142 and a blower 144 are associated in series with the fluid outlet of the destructive distillation zone 18; a pressure recorder controller 146 connected to a motor valve 148 and a blower 150 are associated in series with the fluid outlet from the carbon recovery zone 20; a pressure recorder controller 152 connected to a motor valve 154 and a blower 156 are associated in series with the fluid outlet of the first heat recovery zone 24; and a pressure recorder controller 157 connected to motor valve 158 and a blower 160 are associated in series with the fluid outlet of the second heat recovery zone 26.

A means 162 is further provided for controlling the pressure in the preheating zone 22. The means 162 comprises a bypass line 164 which connects the conduit means 34 with the conduit means 36. The bypass line 164 preferably has a cooler 166 associated therewith for recuperating at least a portion of the heat content of the stream carried by the line. If desired, the preheat zone 22 can be bypassed altogether by closing the valve 165. A valve 168, preferably a motor valve, is also positioned in the line 164 and is manipulated responsively to a signal from a means 170 for establishing a signal representative of the pressure in the upper portion of the zone 22. A suitable means 170 comprises a pressure recorder controller.

To further assist in pressure control of the zone 18, a bypass line 172 connects the conduit means 73 with the conduit means 88, which connects the conduit means 72 with the condenser 82. A cooler 174 is preferably positioned in the line 172 to recuperate a portion of heat therefrom. A valve 176, preferably a motor valve, is positioned in the means 73 between the bypass line 172 and the zone 18 and is associated with a means 178 for establishing a signal representative of the pressure in the upper portion of the zone 18 so as to be manipulated thereby. The means 178 can comprise a pressure recorder controller, for example. Preferably, the conduit means 73 empties into the conduit means 76 connecting the external combustor 74 with the zone 18 to temper the hot gases entering the zone 18 and reduce the possibility of localized hot spots and excessive thermal cracking or carbonate decomposition.

A branch line 180 off conduit means 94 connects the source of oxygen-containing gas 92 with the upper portion of the carbon recovery zone 20. The branch line 180 preferably has a valve, perferably a motor valve 182 associated therewith. A pressure sensor 184, such as a pressure recorder controller, is associated with the upper portion of the zone 20 so as to generate a signal representative of the pressure in the upper portion of the zone 20. The valve 182 is connected to the pressure recorder controller 184 so as to be manipulated in response to the pressure in the zone 20.

According to further aspects of the present invention, there is provided a process for recovering oil from a mineral material which contains hydrocarbon values. Generally the mineral material is selected from the group consisting of lignite, tar sands, and oil shale and preferably the mineral material comprises oil shale. Generally, the mineral material will be in particulate form having a particle size which is usually in the range of from about 0.1 to about 10 inches and preferably in the range of from about 0.2 to about 6 inches. The process is applicable to material which is carried on a grate sequentially through a destructive distillation zone or pyrolysis zone and a carbon recovery or combustion zone. A straight line or circular grate can be used. Preferably, a circular grate is used since the capital investment will be less.

The process is characterized by a molecular oxygen-containing gas being circulated into the carbon combustion zone which contains between about 1 and 12 percent by volume of molecular oxygen and has a heat of combustion of less than about 50 BTU/SCF. This stream can be formed by diluting air with combustion gases from the carbon combustion zone, preferably after they have been cooled. The hot gases can be cooled by circulating them through a preheating zone preceding the pyrolysis zone. Preferably, the hot gases and material in the preheating zone flow in countercurrent arrangement since intimate countercurrent contact provides for highly efficient heat transfer. However, the invention is also applicable to other methods of hot gas circulation through the preheating zone, such as down flow of the gases through the material on a grate. Generally speaking, the material in the preheating zone is heated to a temperature in the range of from about 300° to about 800° F., generally from about 400° to 750° F., and preferably in the range of from about 450° to about 650° F. It is important that the material in the preheating zone not be heated to a temperature which causes substantial hydrocarbon evolution because this would raise the energy content of the stream entering the carbon combustion zone. For example, preheating the material in the preheat zone to a temperature of about 550° F. can be used to provide good results. Generally, the hot gases entering the preheat zone will be at a temperature in the range of from about 400° F. to about 1400° F., although it is more desirable that the upper temperature limit be maintained below a temperature which might result in substantial hydrocarbon evolution. For this reason, a temperature range from about 400° to about 900° F. is expected to provide good results. Most preferably, the hot gases are at a temperature in the range of from about 500° to about 750° F. The time over which the preheating step is carried out will generally range from about 30 seconds up to 30 minutes or so. Longer time periods can be utilized if desired but will require a longer grate and are not expected to yield an appreciable advantage. Usually, the preheating step will be carried out over a time period in the range of from about 2 minutes to about 20 minutes.

The gases withdrawn from the preheating zone will generally be substantially cooler than the gases which entered. Preferably, these gases contain little or no combustible component such as hydrogen, carbon monoxide, and light hydrocarbons such as methane, ethane and the like, and preferably have a heat of combustion of less than 25 BTU/SCF. Usually, the gases withdrawn from the preheating zone will be at a temperature in the range of from about 50° F. to about 250° F., preferably in the range of from about 70° F. to about 150° F. or such temperature as will provide suitable stack draft where all or a portion of the gases are to be exhausted. Most preferably, the gases withdrawn from the preheating zone will consist essentially of inert components which are unoxidizable or reducible under conditions found in the unit. A mixture of nitrogen, carbon dioxide, and water vapor is presently most preferred.

Hot gases are circulated through the material in the destructive distillation zone. Pyrolysis and evolution of oil is significant at temperatures above 800° F., so the pyrolysis zone is usually designed to heat the material to a temperature in the range of 800° to say 1600° F. Selectivity for oil is greater at the lower temperatures and selectivity for gases is greater at the higher temperatures in this range. Where oil is the desired product and the material comprises oil shale the destructive distillation zone will be operated to heat the mineral material, generally to a temperature in the range of 800° F. to about 1200° F., usually in the range of from about 850° F. to about 1050° F. Oil shale is preferably brought up to the desired temperature over a time period in the range of from about 0.5 minutes to about 50 minutes, preferably over a time period in the range of from about 1 to 10 minutes where it has been preheated to a temperature in the range of 500° F. to 600° F. The time period spent by the material in the destructive distillation zone will usually be in the range of from about 5 minutes to about 500 minutes, usually in the range of from about 10 to about 100 minutes. Flow of gases through the material on the grate is preferably downwardly so that oil which is drawn off can be collected with the assistance of gravity. In order to bring the material up to destructive distillation temperatures in a reasonable period of time, the hot gases introduced into the destructive distillation zone are usually at a temperature well above the temperature which is desirable to impart to the material. Where the hot gases are formed in an external combustor, they will usually comprise carbon dioxide, water, and nitrogen and generally be at a temperature in the range of from about 950° to about 1950° F., or metallurgical limits, usually in the range of from about 1100° to about 1600° F., and preferably at a temperature in the range of from about 1200° to about 1400° F. The gases and liquids withdrawn from the destructive distillation zone will generally be at a temperature in the range of from about 500° to 800° F., usually in the range of from about 600° to 700° F. The oil and product combustible gases, usually termed process gases, are withdrawn from the destructive distillation zone and charged to a vapor/liquid separation zone for separation into desired product streams.

A blended oxygen-containing gas is introduced into the carbon recovery zone. Preferably, the blended gases introduced into the carbon recovery zone consist substantially of nitrogen, carbon dioxide, and water vapor and have a free oxygen content in the range of from about 1 mole percent to about 10 mole percent, usually from about 2 mole percent to about 8 mole percent and preferably in the range of from about 3 mole percent to about 7 mole percent. The oxygen-containing gas which is blended with the inert gases, such as withdrawn gases from the preheating zone, preferably is drawn from air. Where the air is preheated prior to being blended and introduced into the carbon recovery zone, it is preferably heated sufficiently to impart to the gas introduced into the carbon recovery zone a temperature in the range of from about 120° F. to about 1200° F., usually in the range of from about 200° F. to about 900° F., preferably in the range of from about 250° F. to about 750° F. The oxygen reacts with the hot material entering the carbon recovery zone, burning the carbon and liberating heat. The material entering the carbon recovery zone is generally at the final retorting temperature, usually in the range of from about 900° to about 1200° F. The hot gases produced by the carbon combustion process are generally at only a slightly higher temperature, preferably below the temperature at which carbonate decomposition becomes substantial, which is about 1300° F. Usually, the hot gases produced during carbon recovery will have a temperature in the range of from about 1000° F. to about 1400° F., usually in the range of from about 1050° F. to about 1300° F. Depending on the length of the carbon recovery zone and the preheated temperature of the combustion supporting gases introduced into the carbon recovery zone the material exiting carbon recovery on the grate will generally have cooled somewhat. Usually, however, the material will still contain considerable heat. For example, it will generally be at a temperature in the range of from about 500° F. to 1000° F., usually at a temperature in the range of from about 600° F. to about 900° F.

At least a portion of the hot gases from the carbon recovery zone can desirably be introduced into the preheating zone for circulating through the material on the grate therein. Preferably, the hot gases from the carbon recovery zone are first cooled to form a tempered hot gas stream by passing the hot gases into indirect heat exchange relationship with a flow of cooling fluid. Usually, the cooling fluid will be water or steam and steam or superheated steam will be produced by cooling the hot gases from the combustion zone. Where it is desired to regulate or temper the temperature of the hot gas stream from carbon combustion a desirable control scheme comprises sensing the temperature of the hot gas stream after it has been tempered, generating a signal representative of the temperature, and manipulating the flow of cooling fluid responsively to the signal. A temperature recorder controller can be associated with the tempered hot gas stream to compare the signal representative of the measured temperature with a set point signal representative of the desired temperature, generating a comparison signal representative of the comparison and the flow of cooling fluid can be manipulated by motor valve responsively to the comparison signal. Whether or not the hot gases from the carbon combustion zone are tempered, they can be withdrawn and divided into a first portion and a second portion for the purposes of controlling the pressure in the preheating zone and maximizing heat recovery from the stream. A first portion of the hot gases from the carbon recovery zone can be introduced into the preheating zone. A signal representative of the gas pressure in the preheating zone can be generated. The flow of the second portion of gases from the carbon recovery zone can be manipulated responsively to the pressure signal. The heat from the second portion of gases can be recuperated by passing the second portion of hot gases from the carbon recovery zone into indirect heat exchange relationship with a flow of cooling fluid. These gases can be exhausted in the stack or at least a portion of them circulated back to the carbon recovery zone to reduce the oxygen concentration in the carbon recovery zone.

In one arrangement, the mineral material is fed onto the moving grate from an enclosed chute. It can be preheated as it is fed down the chute and loaded onto the grate. In this embodiment the enclosed chute functions as the preheating zone. A first portion of the gases from the preheating zone can be withdrawn from an upper portion of the chute so that the material and the first portion of hot gases pass through the chute in countercurrent flow. A second portion of the gases can be withdrawn from the preheating zone, such as the lower portion thereof. Preferably, at least a portion of the first and/or second portion of gases withdrawn from the preheating zone are charged to the carbon recovery zone. Usually, these portions will be combined prior to being introduced into the carbon recovery zone.

Preferably, the material from the carbon recovery zone is carried on the grate from the carbon recovery zone into a first heat recovery zone and gases are circulated through the material in the first heat recovery zone to recover a first portion of the heat therefrom. Preferably, at least a portion of the gases from the destructive distillation process are introduced into the first heat recovery zone for circulating through the material on the grate. These process gases can be withdrawn from the first heat recovery zone and recirculated to the destructive distillation zone since they generally will have been heated to a temperature higher than the temperature of the material exiting the preheating zone. Usually, where the combustible gases from the destructive distillation zone are passed through the first heat recovery zone they will be introduced at a temperature in the range of from about 100° F. to about 500° F., usually in the range of from about 100° F. to about 300° F. The temperature of the gases withdrawn from the first heat recovery zone will generally be in the range of from about 600° F. to about 1000° F., usually in the range of from about 750° F. to about 950° F. If desired, the hot combustible gases from the first heat recovery zone can be added as diluent to the stream to enter the destructive distillation zone from the combustor. In this manner, the temperature in the external combustor can be maintained sufficiently high to provide for smooth combustion and the temperature of the gases introduced into the destructive distillation zone can be maintained sufficiently low so as to avoid excessive gas formation or exceeding the metallurgical temperature limits of equipment.

The material is then preferably carried on the grate from the first heat recovery zone into a second heat recovery zone. In the second heat recovery zone, gases are circulated through the material to recover a second portion of the heat therefrom. Preferably, the gases circulated through the material in the second heat recovery zone are formed from a portion of the combustible or process gases from the destructive distillation zone. These gases will preferably enter the second heat recovery zone at a temperature in the range of from about 100° F. to about 400° F., preferably at a temperature in the range of from about 100° F. to about 200° F. and be preheated in the second heat recovery zone to a temperature in the range of from about 200° F. to about 750° F., usually in the range of from about 250° F. to about 650° F. The material on the grate entering the second heat recovery zone will usually be at a temperature in the range of from about 250° F. to about 850° F., usually in the range of from about 300° F. to about 700° F. The material exiting the second heat recovery zone can be discharged if desired and will usually be at a temperature in the range of from about 150° F. to about 350° F.

At least a portion of the process gases from the second heat recovery zone are preferably introduced into an external combustion zone where they are combined with an oxygen-containing gas to form hot combustion gases at least a portion of which can in turn be introduced into the destructive distillation zone for circulation through the material on the grate. If desired, a second portion of the hot combustible gases from the second heat recovery zone can be circulated into indirect heat exchange relationship with the oxygen-containing gas to be introduced into the external combustion zone. To provide a more flexible process, the flow of oxygen-containing gas can be split into two or more streams. The first flow of the oxygen-containing gas can be utilized to combust the process gas from the second heat recovery zone. A second portion of the oxygen-containing gas can be utilized to combust a supplemental flow of combustible fluid which can originate apart from the unit, natural gas, for example, to provide supplemental heat for the hot combustion gases to be circulated through the material in the destructive distillation zone. Where used, the combustion of process gas and supplemental gas can be controlled by sensing the flow rate of the first flow of combustible fluid, which can be the process gas flow for example, generating a first signal representative of the first flow rate, and manipulating the first flow of oxygen-containing gas responsively to the first signal. The flow rate of the second flow of combustible fluid, which can be the supplemental gas for example can be sensed and a second signal generated which is representative of the second flow rate, and the second flow of oxygen-containing gas manipulated responsively to the second signal. The temperature of the hot combustion gases produced by the external combustor can be regulated by sensing the temperatures of the combustion gases formed by combusting the first and second flows of combustible fluid with the first and second flows of oxygen-containing gas and establishing a third signal representative of the temperature, establishing a fourth signal representative of a predetermined relationship between the second signal (supplemental fuel) and the third signal and manipulating the flow rate of the second flow of combustible fluid responsively to the fourth signal. In a preferred embodiment, a temperature recorder controller connected to the combustion gas conduit immediately prior to the destructive distillation zone produces the signal which biases the signal from the flow recorder controller, manipulating the flow of gas through the supplemental feed line.

The invention is illustrated by the following example.

EXAMPLE

A simple experiment was conducted to determine how the presence of combustible gas in the oxidant stream influences the flame front during carbon burnoff of spent shale. For each of three runs a 4-gram sample of retorted western oil shale was ground to 20–40 mesh and packed into a ½" I.D. transparent tube in four 1-gram portions separated by a thin layer of quartz chips. The bed void fraction was about 0.45 and volume was about 4.4 $cm^3$. The tube was placed in a furnace heated to 1200° F. (650° C.) and the oxidant stream, at about 1200° F., 1 atmosphere, and comprising 5.23 vol.% $O_2$ in helium was flowed through the tube at about 150 $cm^3$/min to provide a residence time of 0.8 seconds and a space velocity of 2000 $hr^{-1}$. At various time intervals, the tube was pulled from the furnace and the progress of the flame front was visually estimated by the location of the bed discontinuity between the layers of quartz chips. The table below illustrates the effect of small amounts of methane on the advance of the combustion front. A similar effect was observed when the test was conducted with carbon monoxide as the combustible in the oxidant stream.

TABLE

| Time | Front Location, % of bed | | |
|---|---|---|---|
| (min) | 0 BTU/SCF Me | 26 BTU/SCF Me | 55 BTU/SCF Me |
| 5 | 19 | 15 | 15 |
| 10 | 32 | 28 | — |
| 15 | — | 40 | 34 |
| 20 | 60 | 50 | — |
| 25 | — | — | 45 |
| 30 | 91 | 70 | — |
| 35 | 100 | — | 52 |
| 40 | — | 92 | — |
| 45 | — | — | — |
| 50 | — | 97 | — |
| 60 | — | — | 65 |
| 92 | — | — | 75 |
| 180 | — | — | 84 |

At 26 BTU/SCF, the oxidant stream contained about 2.6 vol.% methane and the burning of residual carbon was markedly impaired. At 55 BTU/SCF the oxidant stream contained about 5.5 vol.% methane and carbon burnoff was seriously impaired.

What is claimed is:

1. In an apparatus comprising:

a housing having an inlet for introducing particulate material and an outlet for exhausting particulate material, a dividing means positioned in the housing dividing the housing into at least a destructive distillation zone and a carbon combustion zone;

a movable grate positioned in the housing dividing the housing into upper portion and a lower portion and dividing each of said zones into an upper portion and a lower portion, each of said zones having a fluid inlet in the upper portion and fluid outlet in the lower position; and a means for moving the grate through the housing; the improvement comprising (a) a means separate from the destructive distillation zone and the carbon combustion zone for defining a flow path from the lower portion of the carbon combustion zone to the upper portion of the carbon combustion zone; and (b) a means positioned with respect to the means defining the flow path for cooling a fluid flow through the means defining the flow path.

2. Apparatus as in claim 1 wherein the dividing means further divides the housing to form a preheat zone, said preheat zone being divided by the movable grate into a upper portion and a lower portion; the destructive distillation zone being positioned between the preheat zone and the carbon combustion zone, and the means defining a flow path between the lower portion of the carbon combustion zone and the upper portion of the carbon combustion zone comprises a first conduit means connecting the lower portion of the carbon combustion zone with the upper portion of the preheat zone and a second conduit means connecting the lower portion of the preheating zone with the upper portion of the carbon combustion zone, said preheating zone forming at least a portion of the means for cooling a fluid flow through the means defining the flow path between the lower portion of the carbon recovery zone and the upper portion of the carbon recovery zone.

3. Apparatus as in claim 2 wherein the means for cooling a fluid flow through the means defining the flow path between the lower portion of the carbon recovery zone and the upper portion of the carbon recovery zone includes a cooler positioned with respect to the first conduit means for cooling the contents thereof.

4. Apparatus as in claim 3 further comprising a temperature sensor positioned and arranged with respect to the first conduit means between the cooler and the preheat zone so as to sense the temperature of the fluid in the first conduit means, said temperature sensor being constructed so as to produce a signal representative of the fluid temperature in the first conduit means, a cooling fluid feed line for the cooler having a valve positioned therein said feed line being connected to the cooler, and a means positioned and arranged with respect to the temperature sensor and the valve for manipulating the valve responsively to the signal from the temperature sensor.

5. Apparatus as in claim 4 further comprising a tubular chute emptying into the upper portion of the preheat zone, said chute having an upper end positioned to receive particulate material from a source of particulate material and a lower end positioned to deposit particulate material on the movable grate; a particle feeder positioned in the upper end of the chute to control the admission of particulate into the chute and a valve or choke at the lower end of the chute to throttle the exhaust of particulate material form the chute onto the grate, wherein the second conduit means means defining a flow path from the lower portion of the preheating zone to the upper portion of the carbon combustion zone includes a conduit means connecting the upper portion of the chute with the upper portion of the carbon combustion zone.

6. Apparatus as in claim 2 wherein the dividing means further divides the housing to form a first heat recovery zone and said gate divides said first heat recovery zone into an upper portion and a lower portion and said first heat recovery zone has a fluid inlet in its upper portion and an outlet in its lower portion, the carbon combustion zone being positioned between the first heat recovery zone and the destructive distillation zone; said apparatus further comprising:

a means providing a gas/liquid separation zone connected to the outlet in the lower portion of the destructive distillation zone, said gas/liquid separation zone having a gas outlet and a liquid outlet; and a conduit means connecting the gas outlet of said gas/liquid separation zone with the fluid inlet in the upper portion of the first heat recovery zone.

7. Apparatus as in claim 6 further comprising an external combustor and a conduit means connecting the external combustor with the fluid inlet in the upper portion of the destructive distillation zone.

8. Apparatus as in claim 7 wherein the dividing means further divides the housing to form a second heat recovery zone following the first heat recovery zone, said grate divides said second heat recovery zone into an upper portion and a lower portion and said second heat recovery zone has a fluid inlet in its upper portion and a fluid outlet in its lower portion, the first heat recovery zone being positioned between the second heat recovery zone and the carbon combustion zone, said apparatus further comprising a conduit means connecting the fluid outlet in the lower portion of the second heat recovery zone with the external combustor, a conduit means connecting the gas outlet of the liquid/gas separation zone with the fluid inlet of the second heat recovery zone; a source of oxygen-containing gas and a conduit means including an indirect heat exchanger connecting the source of oxygen-containing gas with the external combustor; and a conduit means connecting the fluid outlet in the lower portion of the second heat recovery zone with said indirect heat exchanger.

9. Apparatus as in claim 8 further comprising a source of supplemental fuel and a conduit means connecting the source of supplemental fuel with the external combustor.

10. Apparatus as in claim 9 further comprising a temperature sensor positioned and arranged with respect to the conduit means connecting the external combustor with the destructive distillation zone, said temperature sensor constructed so as to produce a signal representative of the fluid temperature in the conduit means; a valve positioned in the conduit means connecting the source of supplemental fuel with the external combustor; and a means positioned and arranged with respect to the temperature sensor and the valve for manipulating the valve responsively to the signal from the temperature sensor.

11. Apparatus as in claim 10 further comprising a means positioned and arranged with respect to each of the preheat zone, the destructive distillation zone, the carbon combustion zone, the first heat recovery zone, and the second heat recovery zone for maintaining each of said zones at about equal pressures.

* * * * *